US009763512B1

(12) United States Patent
Jones

(10) Patent No.: US 9,763,512 B1
(45) Date of Patent: Sep. 19, 2017

(54) BASEBOARD PRO SYSTEM

(71) Applicant: Jeremiah Jones, Horn Lake, MS (US)

(72) Inventor: Jeremiah Jones, Horn Lake, MS (US)

( * ) Notice: Subject to any disclaimer, the term of this patent is extended or adjusted under 35 U.S.C. 154(b) by 26 days.

(21) Appl. No.: 14/992,330

(22) Filed: Jan. 11, 2016

Related U.S. Application Data

(60) Provisional application No. 62/152,371, filed on Apr. 24, 2015.

(51) Int. Cl.
*A47L 13/12* (2006.01)
*A46B 11/00* (2006.01)
*A46B 5/00* (2006.01)

(52) U.S. Cl.
CPC ..... *A46B 11/001* (2013.01); *A46B 5/0054* (2013.01); *A47L 13/12* (2013.01)

(58) Field of Classification Search
CPC ..... A47L 13/12
USPC ..... 15/28, 29, 52, 230; 401/22, 24, 39
See application file for complete search history.

(56) References Cited

U.S. PATENT DOCUMENTS 7,296,943 B2 11/2007 Sandoval
7,418,758 B1 9/2008 Avila
8,276,236 B2 10/2012 Goodman et al.

*Primary Examiner* — David Walczak
*Assistant Examiner* — Joshua Wiljanen
(74) *Attorney, Agent, or Firm* — PG Patent Consulting, LLC; Rachel Gilboy

(57) ABSTRACT

A baseboard cleaning apparatus includes an elongated hollow handle member having a first end including a removable cap thereon and a second end; a base portion including a hollow housing, a ball and socket connector, a wet roller, a brush roller located on the side of the base portion, and a drying roller; and a cleaning fluid. When the baseboard cleaning apparatus is in use the cleaning fluid is allowed to flow into the wet roller and the wet, brush, and drying rollers are adapted to be pressed against a baseboard and a floor simultaneously and then pushed by the handle member in a linear direction thereby rolling the rollers along the floor and rubbing against the baseboard at the same time thereby cleaning the baseboard.

7 Claims, 4 Drawing Sheets

BASEBOARD PRO SYSTEM

CROSS-REFERENCE TO RELATED APPLICATION

The present application is related to and claims priority from prior provisional application Ser. No. 62/152,371, filed Apr. 24, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tools for cleaning baseboards and more specifically relates to a baseboard cleaning apparatus to dampen, clean, and dry baseboards thoroughly, so a user does not have to be on their hands and knees to accomplish the task while providing a fast and effective way to clean scrub and dry the baseboards.

2. Description of the Related Art

In architecture, a baseboard (also called skirting board, skirting, mopboard, floor molding, as well as base molding) is a (generally wooden) board covering the lowest part of an interior wall. Its purpose is to cover the joint between the wall surface and the floor. It covers the uneven edge of flooring next to the wall; protects the wall from kicks, abrasion, and furniture; and can serve as a decorative molding. At its simplest, baseboard consists of a simple plank nailed, screwed or glued to the wall; however, particularly in older houses, it can be made up of a number of moldings for decoration. Plastic baseboard comes in various plastic compounds, the most common of which is UPVC. It is usually available in white or a flexible version in several colors and is usually glued to the wall. Vinyl baseboard is glued with adhesive and can be difficult to remove or to replace. It has a long lifespan, which can mean lower maintenance.

Cleaning baseboards is always an arduous task. Too often, baseboards are just dusted using a vacuum cleaner brush or a broom. To do a thorough job of cleaning, the person cleaning must be down on hands and knees, often using a sponge or scrubber to eliminate stubborn accumulations. Unfortunately, it is very uncomfortable to clean the baseboards while on his hands and knees, and bending over to reach the baseboards creates too much stress on his back.

Various attempts have been made to solve the above-mentioned problems such as those found in U.S. Pat. No. 7,296,943 to Yvonne Sandoval; U.S. Pat. No. 8,276,236 to Goodman et al.; and U.S. Pat. No. 7,418,758 to Jorge Avila. This art is representative of tools for cleaning baseboards.

None of the above inventions and patents, taken either singly or in combination, is seen to describe the invention as claimed.

Ideally, a baseboard cleaning apparatus should be user-friendly and safe in-use and, yet may operate reliably and be manufactured at a modest expense. Thus, a need exists for a baseboard cleaning apparatus to dampen, clean, and dry baseboards thoroughly, so a user does not have to be on their hands and knees to accomplish the task while providing a fast and effective way to clean scrub and dry the baseboards and to avoid the above mentioned problems.

BRIEF SUMMARY OF THE INVENTION

In view of the foregoing disadvantages inherent in the known of tools for cleaning baseboards art, the present invention provides a baseboard cleaning apparatus (Baseboard Pro System). The general purpose of the present invention, which will be described subsequently in greater detail is to provide a baseboard cleaning apparatus to dampen, clean, and dry baseboards thoroughly, so a user does not have to be on their hands and knees to accomplish the task while providing a fast and effective way to clean scrub and dry the baseboards.

A baseboard cleaning apparatus comprises an elongated hollow handle member having a first end including a removable cap thereon and a second end; a base portion including a hollow housing, a ball and socket connector, a wet roller located on a side of the base portion, a brush roller located on the side of the base portion and adjacent to the wet roller, and a drying roller located on a side of the base portion adjacent to the brush roller and on an opposite side from the wet roller; and a cleaning fluid. When the baseboard cleaning apparatus is in use the cleaning fluid is allowed to flow into the wet roller and the wet, brush, and drying rollers are adapted to be pressed against a baseboard and a floor simultaneously and then pushed by the handle member in a linear direction thereby rolling the rollers along the floor and rubbing against the baseboard at the same time thereby cleaning the baseboard.

The elongated hollow handle member is adapted to hold a cleaning fluid therein. The second end has an opening therethrough. The cleaning fluid can pass through the opening. The cleaning fluid is placed within said hollow handle member and is allowed to flow through said handle member and into said wet roller for use cleaning the baseboard.

The hollow housing on the base portion is adapted to hold the cleaning fluid from the hollow handle member therein. The ball and socket connector is connected to a top portion thereof and is adapted to releasably connect with the second end of the handle member. The ball and socket connector includes a passageway therethrough adapted to allow the cleaning fluid to pass from the handle member into the housing. The ball and socket connector allows the housing to pivot with respect to the handle member in all directions.

The handle member includes two elongated portions slidably and telescopingly connected together to thereby provide a means for length adjustment. The handle member includes a button adapted to allow or stop the flow of cleaning fluid through the handle member and to the wet roller. The handle member and said base portion are formed from a material chosen from a group of materials consisting of plastic and metal.

The wet roller includes a center axle and a sponge on an outer surface thereof. The center axle is rotatably connected to the side of the base portion and having hollow shaft therethrough. The hollow shaft is adapted to allow the cleaning fluid to pass from the housing and into the sponge to thereby be adapted to provide a means for wetting the surface of a baseboard with the cleaning fluid.

The brush roller includes a center axle and a brush portion. The brush roller center axle is rotatably connected to the side of the base portion. The brush portion includes bristles on an outer surface thereof and is adapted to provide a means for scrubbing the surface of said baseboard after said cleaning fluid has been applied.

The drying roller includes a center axle and a sponge on an outer surface thereof. The dry roller center axle is rotatably connected to the side of said base. The drying roller sponge is adapted to provide a means for drying the surface of said baseboard after it has been scrubbed by the brush roller.

Each of the rollers has a diameter that is larger than a height of said base portion, such that when in use said rollers are adapted to contact and roll along a floor surface without said base portion contacting said floor surface. The diameters of each said rollers are equal. The rollers are equally spaced from one another upon said base portion.

The present invention holds significant improvements and serves as a baseboard cleaning apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, baseboard cleaning apparatus (entitled Baseboard Pro System) constructed and operative according to the teachings of the present invention.

The various embodiments of the present invention will hereinafter be described in conjunction with the appended drawings, wherein like designations denote like elements

DETAILED DESCRIPTION

Figure 1:
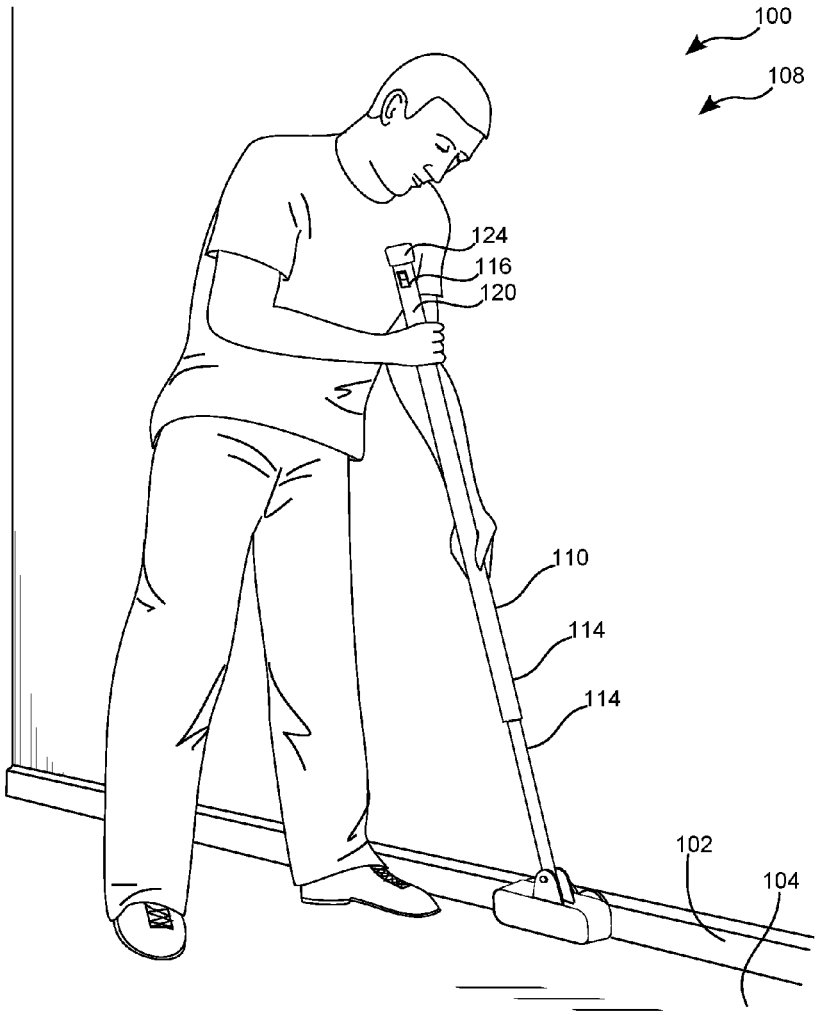
FIG. 1 shows a front perspective view illustrating a baseboard cleaning apparatus in an 'in-use' condition according to an embodiment of the present invention.
Figure 2:
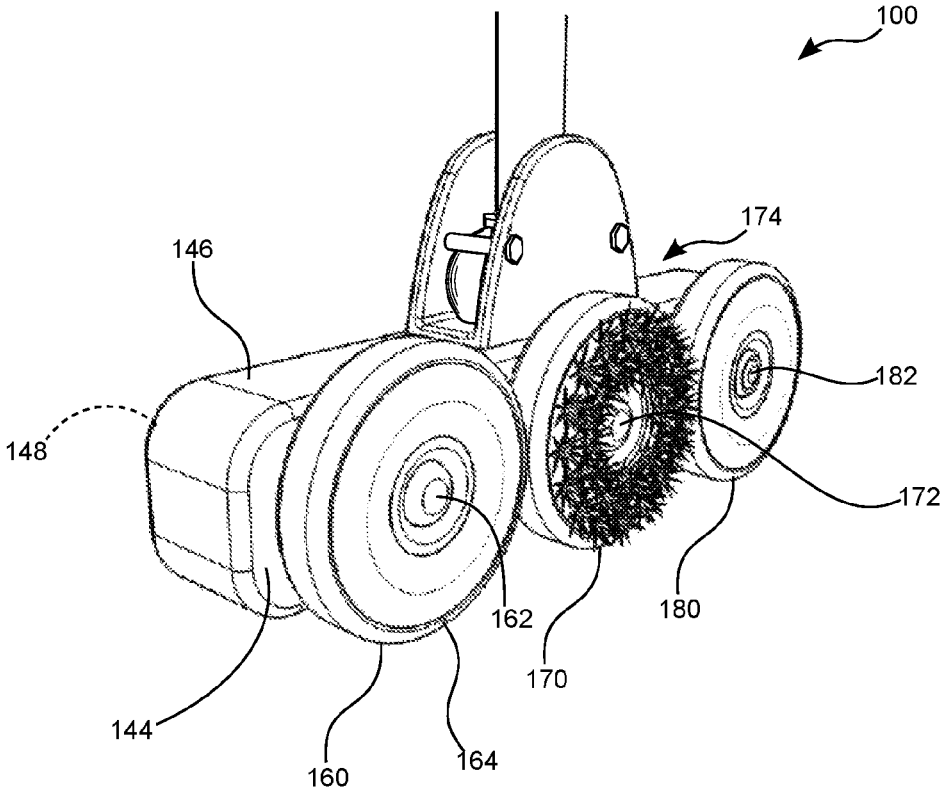
FIG. 2 shows a front perspective view illustrating the baseboard cleaning apparatus according to an embodiment of the present invention.

As discussed above, embodiments of the present invention relate to a tool for cleaning baseboards and more particularly to a baseboard cleaning apparatus (entitled Baseboard Pro System) to dampen, clean, and dry baseboards thoroughly, so a user does not have to be on their hands and knees to accomplish the task while providing a fast and effective way to clean scrub and dry the baseboards.

Generally speaking, Baseboard Pro System is designed to make the job of cleaning baseboards easier to do and without having to endure physical discomfort. It functions like a mop or duster for the baseboards, with wheels that rotate and glide along the baseboard. A cleaning solution, to moisten the baseboard, is released from the first wheel. The second wheel has scrubbing bristles to remove the dirt, and the third wheel has a pad for drying the baseboard. A separate accessory can be attached to the same handle, if the user needs to dust the baseboards, rather than scrubbing them. There is a cap at the top of the handle, which is removed for adding cleaning solution when needed, and the solution is released from the center of the first wheel using the trigger on the handle.

The unique features of this product will provide the following benefits for consumers everywhere:

- A new tool to clean baseboards thoroughly, without having to be on one's hands and knees or to bend over while cleaning;
- Saves a great deal of time with needing to scrub baseboards; Allows cleaners to stand upright while cleaning the baseboards thoroughly;
- Eliminates physical stress and strain usually required to scrub baseboards;
- Can be used for dusting as well as scrubbing and drying baseboards.

Referring now to the drawings by numerals of reference there is shown in FIGS. 1-4 perspective views illustrating baseboard cleaning apparatus 100 according to an embodiment of the present invention.

Baseboard cleaning apparatus 100 comprises elongated hollow handle member 110 having first end 120 including removable cap 124 thereon and second end 130; base portion 140 including hollow housing 142, ball and socket connector 150, wet roller 160 located on first side 144 of base portion 140, brush roller 170 located on second side 146 of base portion 140 and adjacent to wet roller 160, and drying roller 180 located on third side 148 of base portion 140 adjacent to brush roller 170 and on an opposite side from wet roller 160; and cleaning fluid 190. When baseboard cleaning apparatus 100 is in in-use condition drying roller 108 as shown in FIG. 1, cleaning fluid 190 is allowed to flow into wet roller 160 and wet roller 160, brush roller 170, and drying roller 180 are adapted to be pressed against baseboard 102 and floor 104 simultaneously and then pushed by handle member 110 in a linear direction thereby rolling wet roller 160 and wet roller 160, brush roller 170, and drying roller 180 along floor 104 and rubbing against baseboard 102 at the same time thereby cleaning baseboard 102.

Elongated hollow handle member 110 is adapted to hold cleaning fluid 190 therein. Second end 130 has opening 134 therethrough. Cleaning fluid 190 can pass through opening 134. Cleaning fluid 190 is placed within hollow handle member 110 and is allowed to flow through handle member 110 and into wet roller 160 for use cleaning baseboard 102.

Figure 4:
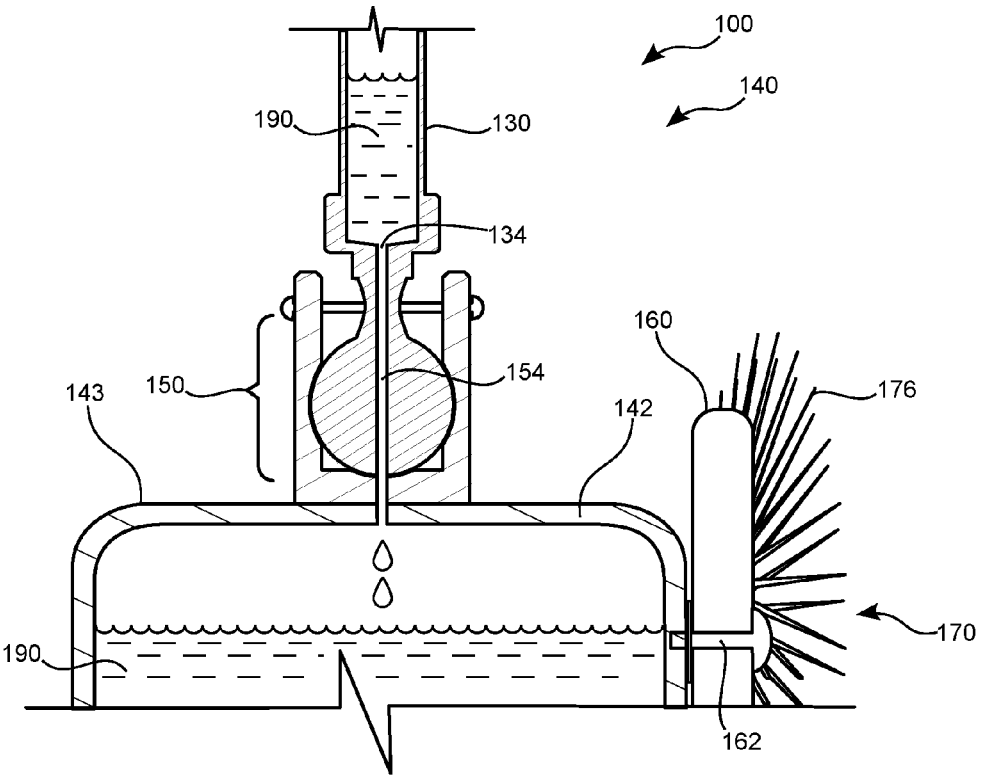
FIG. 4 is a perspective view illustrating a ball and socket connector for connecting a base portion to the elongated handle of the baseboard cleaning apparatus according to an embodiment of the present invention.

Hollow housing 142 on base portion 140 is adapted to hold cleaning fluid 190 from hollow handle member 110 therein. Ball and socket connector 150 is connected to top portion 143 of base portion 140 and is adapted to releasably connect with second end 130 of handle member 110 as shown in FIG. 4. Ball and socket connector 150 includes passageway 154 therethrough adapted to allow cleaning fluid 190 to pass from handle member 110 into the housing 142. Ball and socket connector 150 allows housing 142 to pivot with respect to handle member 110 in all directions.

Figure 3:
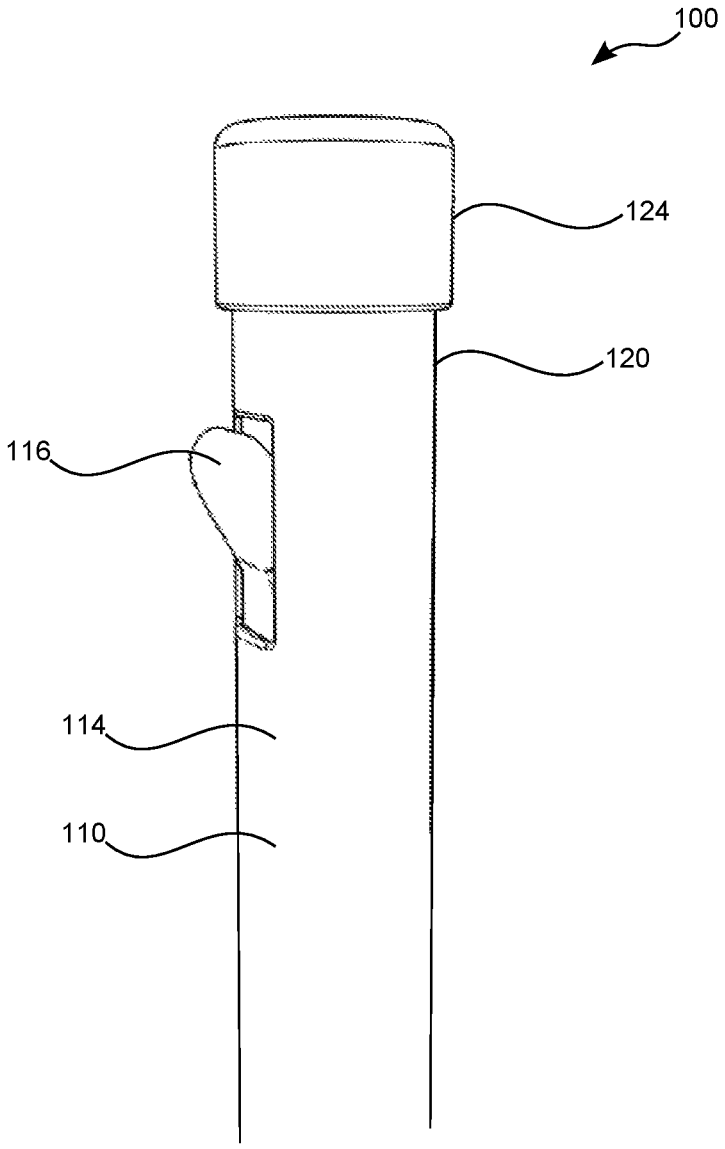
FIG. 3 is a perspective view illustrating an elongated hollow handle member of baseboard cleaning apparatus according to an embodiment of the present invention

Handle member 110 includes two elongated portions 114 slidably and telescopingly connected together to thereby provide a means for length adjustment. Handle member 110 includes button 116 adapted to allow or stop the flow of cleaning fluid 190 through handle member 110 and to the wet roller as shown in FIG. 3. Handle member 110 and base portion 140 are formed from a material chosen from a group of materials consisting of plastic and metal.

Wet roller 160 includes center axle 162 and sponge 164 on an outer surface thereof. Center axle 164 is rotatably connected to first side 144 of base portion 140 and having hollow shaft 166 therethrough. Hollow shaft 166 is adapted to allow cleaning fluid 190 to pass from housing 142 and into sponge 164 to thereby be adapted to provide a means for wetting the surface of baseboard 102 with cleaning fluid 190.

Brush roller 170 includes center axle 172 and brush portion 174. Brush roller center axle 172 is rotatably connected to second side 146 of base portion 140. Brush portion 174 includes bristles 176 on an outer surface thereof and is adapted to provide a means for scrubbing the surface of baseboard 102 after cleaning fluid 190 has been applied.

Drying roller 180 includes center axle 182 and sponge 184 on an outer surface thereof. Dry roller center axle 182 is rotatably connected to third side 148 of base 140. Drying roller sponge 184 is adapted to provide a means for drying the surface of baseboard 102 after it has been scrubbed by brush roller 170.

Each of the rollers (wet roller 160, brush roller 170, and drying roller 180) has a diameter that is larger than a height of base portion 140, such that when in use, wet roller 160, brush roller 170, and drying roller 180 are adapted to contact and roll along floor surface 104 without base portion 140 contacting floor surface 104. The diameters of wet roller 160, brush roller 170, and drying roller 180 are equal. Wet roller 160, brush roller 170, and drying roller 180 are equally spaced from one another upon said base portion.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A baseboard cleaning apparatus comprising:
an elongated hollow handle member having;
a first end including a removable cap thereon;
wherein said elongated hollow handle member is adapted to hold a cleaning fluid therein;
an second end having;
an opening therethrough;
wherein said cleaning fluid can pass through said opening;
a base portion including;
a hollow housing;
wherein said housing is adapted to hold said cleaning fluid from said hollow handle member therein;
a ball and socket connector;
wherein said ball and socket connector is connected to a top portion thereof and is adapted to releasably connect with said second end of said handle member;
wherein said ball and socket connector includes a passageway therethrough adapted to allow said cleaning fluid to pass from said handle member into said housing; and
wherein said ball and socket connector allows said housing to pivot with respect to said handle member in all directions;
a wet roller located on a side of said base portion and including;
a center axle;
wherein said center axle is rotatably connected to said side of said base portion and having a hollow shaft therethrough; and
a sponge on an outer surface thereof;
wherein said hollow shaft is adapted to allow said cleaning fluid to pass from said housing and into said sponge to thereby be adapted to provide a means for wetting the surface of a baseboard with said cleaning fluid;
a brush roller located on said side of said base portion and adjacent to said wet roller, said brush roller including;
a center axle;
wherein said brush roller center axle is rotatably connected to said side of said base portion;
a brush portion;
wherein said brush portion includes bristles on an outer surface thereof and is adapted to provide a means for scrubbing the surface of said baseboard after said cleaning fluid has been applied; and
a drying roller located on a side of said base portion adjacent to said brush roller and on an opposite side from said wet roller, said drying roller including;
a center axle;
wherein said dry roller center axle is rotatably connected to said side of said base; and
a sponge on an outer surface thereof;
wherein said drying roller sponge is adapted to provide a means for drying the surface of said baseboard after it has been scrubbed by said brush roller; and
a cleaning fluid;
wherein said cleaning fluid is placed within said hollow handle member and is allowed to flow through said handle member and into said wet roller for use cleaning said baseboard;
such that when in use said cleaning fluid is allowed to flow into said wet roller and said wet, brush, and drying rollers are adapted to be pressed against a baseboard and a floor simultaneously and then pushed by said handle member in a linear direction thereby rolling said rollers along said floor and rubbing against said baseboard at the same time thereby cleaning said baseboard.

2. The apparatus of claim 1, wherein said handle member includes two elongated portions slidably and telescopingly connected together to thereby provide a means for length adjustment.

3. The apparatus of claim 1, wherein said handle member includes a button adapted to allow or stop the flow of cleaning fluid through said handle member and to said wet roller.

4. The apparatus of claim 1, wherein said handle member and said base portion are formed from a material chosen from a group of materials consisting of plastic and metal.

5. The apparatus of claim 1, wherein each of said rollers has a diameter that is larger than a height of said base portion, such that when in use said rollers are adapted to contact and roll along a floor surface without said base portion contacting said floor surface.

6. The apparatus of claim 5, wherein said diameters of each said rollers are equal.

7. The apparatus of claim 1, wherein said rollers are equally spaced from one another upon said base portion.

* * * * *